US006309300B1

(12) United States Patent
Glavich

(10) Patent No.: US 6,309,300 B1
(45) Date of Patent: Oct. 30, 2001

(54) GAMING BONUS APPARATUS AND METHOD WITH PLAYER INTERACTION

(75) Inventor: Paulina Glavich, Reno, NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/564,493

(22) Filed: May 4, 2000

Related U.S. Application Data

(60) Provisional application No. 60/153,746, filed on Sep. 13, 1999.

(51) Int. Cl.[7] ..... A63F 9/24

(52) U.S. Cl. ..... 463/26; 463/16; 463/20

(58) Field of Search ..... 463/16, 17, 18, 463/19, 20, 13, 12, 6, 25, 21, 26, 27, 42; 273/292, 143 R, 138.1, 138.2, 118 D, 118 R, 123 A, 118 A, 142 B, 142 R, 121 B, 144 R, 269, 274; 902/23

(56) References Cited

U.S. PATENT DOCUMENTS

| | | | | |
|---|---|---|---|---|
| 4,582,324 | * | 4/1986 | Koza et al. . | |
| 4,679,143 | * | 7/1987 | Hagiwara . | |
| 4,695,053 | * | 9/1987 | Vazquez, Jr. et al. . | |
| 4,871,171 | * | 10/1989 | Rivero . | |
| 5,152,529 | * | 10/1992 | Okada . | |
| 5,318,298 | * | 6/1994 | Kelly et al. . | |
| 5,393,057 | * | 2/1995 | Marnell, II . | |
| 5,409,225 | * | 4/1995 | Kelly et al. . | |
| 5,560,603 | * | 10/1996 | Seelig et al. . | |
| 5,743,800 | | 4/1998 | Huard et al. | 463/26 |
| 5,816,918 | * | 10/1998 | Kelly et al. . | |
| 5,855,514 | * | 1/1999 | Kamille . | |
| 5,876,284 | | 3/1999 | Acres et al. | 463/25 |
| 6,089,976 | * | 7/2000 | Schneider et al. . | |
| 6,159,098 | * | 12/2000 | Slomiany et al. . | |
| 6,190,255 | * | 2/2001 | Thomas et al. | 463/20 |

FOREIGN PATENT DOCUMENTS

| | | | | |
|---|---|---|---|---|
| 2072395 | * | 3/1981 | (GB) . | |
| 2083936 | * | 3/1982 | (GB) . | |
| 2222712 | * | 3/1990 | (GB) . | |
| WO 98/09258 | | 3/1998 | (WO) | G07F/17/34 |
| WO98/09259 | | 3/1998 | (WO) | G07F/17/34 |
| WO 99/19037 | | 4/1999 | (WO) | A63F/9/22 |

OTHER PUBLICATIONS

Web page for World Gaming 1998 expo; presented by International Gaming & Wagering Busuness; The Official Tradeshow of The American Gaming Association.

*Jackpot Party Video*™ brochure; Williams Gaming Inc.; www.wmsgaming.com; copyright 1999.

*Dreamweaver*™ brochure; Aristocrat Liesure Industries Pty Ltd. copyright 1997 and Feb. 1998.

* cited by examiner

*Primary Examiner*—Michael O'Neill
(74) *Attorney, Agent, or Firm*—George H. Gerstman; Seyfarth Shaw

(57) ABSTRACT

A gaming system provides a main game and a bonus feature with the bonus feature providing for user interaction. In one aspect, user interaction involves allowing a player to select at least some of a plurality of selectable items. When a selectable item is selected, a prize, multiplier or other item associated with the selectable item is revealed and a total bonus prize is based on the prizes, multipliers or other items associated with the selectable items selected by the player.

29 Claims, 3 Drawing Sheets

GAMING BONUS APPARATUS AND METHOD WITH PLAYER INTERACTION

This application claims benefit of Provisional Application No. 60/153,746 filed Sep. 13, 1999.

Cross-reference is made to application Ser. No. 09/395,034, entitled "Imaging Matching Game Method", filed on Sep. 13, 1999 and incorporated by reference.

The present invention is directed to a gaming apparatus and method which includes a bonus feature and in particular a bonus feature that provides for player interaction such as by selecting among a plurality of selectable items.

BACKGROUND INFORMATION

A number of gaming methods and apparatus provide a bonus feature. As used herein a bonus feature is a feature which provides a player with a desired item (typically, but not necessarily, a monetary prize) after at least some play of the main game. In some situations, a bonus is provided in response to achieving a outcome in the main game (such as by achieving one or more bonus results in the main game, accumulating a threshold number of points or credits in the main game, and the like. Bonusing may be provided in any of a plurality of types of main games such as slot machine games, electronic poker, blackjack or other electronic card games, electronic keno, bingo, item picking games and a plurality of other game types as a main game.

Although bonusing can be attractive both to players (e.g., because of the added interest and entertainment value associated with bonusing) and to game operators (e.g., because of the increased play or attractiveness associated with bonusing games), it is believed there is a potential for further development in bonusing, e.g., to further increase the entertainment value or interest associated with bonusing. For example, many types of bonusing occur substantially automatically, with substantially no opportunity for player interaction, such as bonusing which involves an award of a predetermined or randomly selected prize. Accordingly, it would be useful to provide a gaming apparatus and method having bonusing which provides for a degree of player interaction with the bonusing portion or feature.

Although it is believed interaction with a bonusing feature would be a useful component, when player interaction affects a type or amount of prize, there may be concerns that the resultant variability of the bonusing prize could undesirably diminish or undesirably increase the variability of overall (i.e., averaged over time) prize amounts and thus of game operator hold amounts (thus potentially affecting game operator profits). Furthermore, there may be some regulatory environments in which there are effective bounds on bonusing prizes and/or holds. Accordingly, it would be useful to provide a gaming apparatus and method permitting player interaction with bonusing in which the interaction can affect the bonus prize amount, while achieving bounds or controls on bonusing prizes, at least averaged over time.

At least some main (non-bonus) game portions have provided for a multiplier effect such as by providing certain main game results which result in multiplication of a main game prize. Bonus prizes, however, are typically provided in a non-multiplicative fashion. Accordingly, it would be useful to provide a bonusing feature which has potential for a prize multiplier.

SUMMARY OF THE INVENTION

According to one embodiment of the invention, a play of a main game is followed by a bonus feature in which there is substantial player interaction. According to one aspect, a player is presented with a first number of selectable items, each associated with an "associated item" (which may be, e.g., a prize amount, a "demerit", additional pick opportunities, a multiplier, or combination of such items). The player may select a certain number of such items (with the number of "picks" allowed being less than or equal to, typically less than, the total number of selectable items). The player, at the time of picking an item, does not know which "associated items" are associated with the various selectable items. The player receives, as a bonus prize, the values associated with the selected items. If a selected item is associated with a multiplier, some or all of the bonus prize, such as all previously-selected items, are multiplied by the multiplier value. Preferably, as each item is selected by the player, the associated prize or other item (if any) is revealed. In one embodiment, after the player has exercised all his or her "picks," items associated with any remaining selectable items are uncovered or revealed (e.g., so that the player can see the prizes or other associated items that were missed.

In one aspect a gaming system provides a main game and a bonus feature with the bonus feature providing for user interaction. In one aspect, user interaction involves allowing a player to select at least some of a plurality of selectable items. When a selectable item is selected, a prize, multiplier or other item associated with the selectable item is revealed and a total bonus prize is based on the prizes, multipliers or other items associated with the selectable items selected by the player.

DETAILED DESCRIPTION OF THE PREFERRED EMBODIMENT

Figure 1:
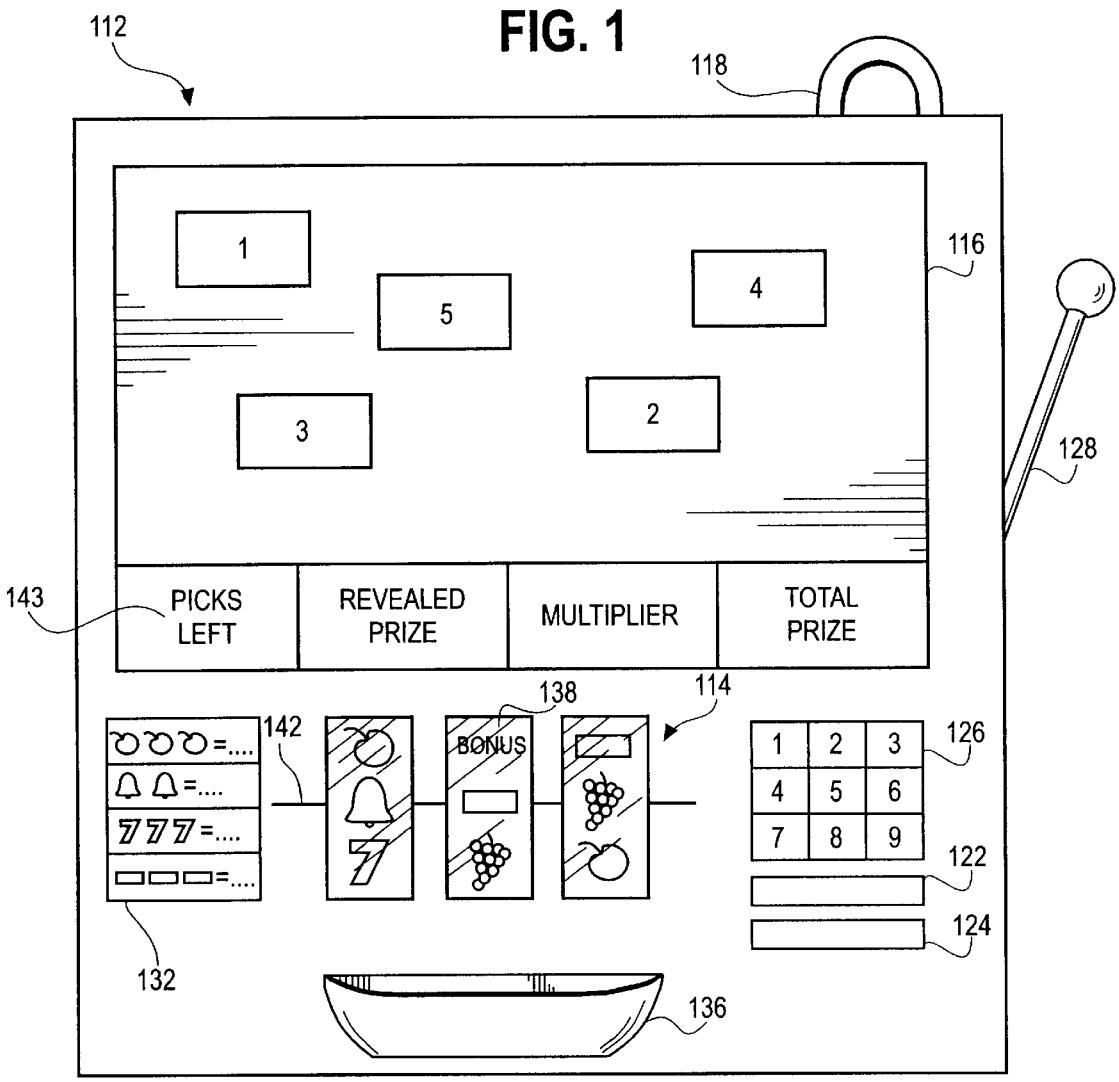
FIG. 1 is a simplified front view of a gaming terminal in accordance with the embodiment of the present invention.

The present invention can be implemented in the context of a number of different apparatus. FIG. 1 depicts a slot machine-type gaming terminal 112 that can be used in the present invention. The gaming terminal depicted in FIG. 1 provides separate areas for the main game and the bonus feature, such as separate slot machine reels 114 and display screen 116. As will be understood by those of skill in the art, after understanding the present disclosure, the present invention can also be implemented in many other types of gaming devices such as a gaming device in which the main game and the bonusing feature are both displayed on the same area such as both being displayed on a single display screen. In the embodiment depicted in FIG. 1, a wager-receiving facility is provided such as by providing a coin input 118, currency input 122 a card reader 124, e.g., for reading a credit card, smart card, frequent player card and the like. It is also possible to provide a keyboard 126 which can be used in connection with inputting wagers such as inputting a password or code relating to preauthorized credit accounts and the like. A handle 128 can be used to initiate play of the main game although other components such as buttons, touchscreens, voice actuation and the like can also be used. Preferably, graphics 132 are provided, e.g., for decoration, attraction, instruction, explanation, display of pay tables and the like.

Figure 4:
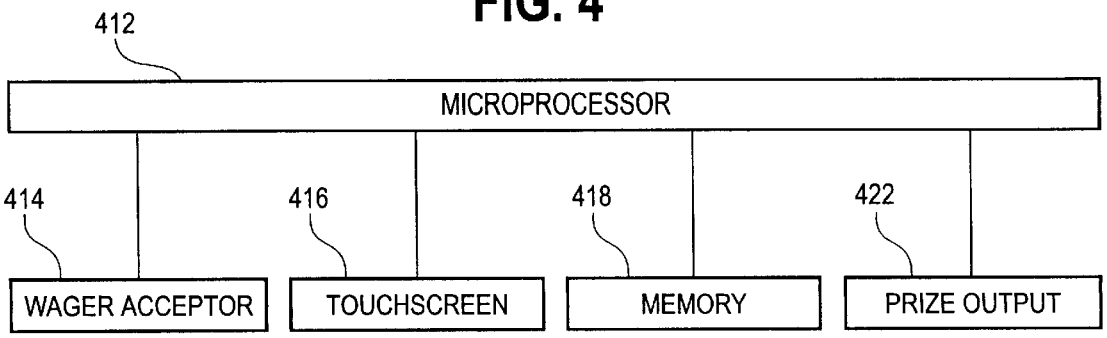
FIG. 4 is a block diagram of a gaming terminal according an embodiment of the present invention.

FIG. 4 depicts a block diagram of certain components of a gaming apparatus that can be used in the present invention. In the block diagram of FIG. 4, a microprocessor 412 coupled to a wager acceptor 414 which can be a coin, currency or card acceptor, or an input device such as a keyboard, or plurality of buttons, voice recognition device, mouse, joy stick, track ball, or other pointer device, touchscreen and the like. In the embodiment depicted in FIG. 4, a touchscreen 416 can provide both input and output including input and output associated with the main game, if desired, as well as input or output associated with the bonusing feature. Touchscreens may be associated with many types of displays including a liquid crystal display (LCD), a cathode ray tube (CRT) display, a mechanical display and the like. In the embodiment of FIG. 4, the microprocessor 412 is coupled to a memory 418 (often in the form of two or more different memory modules or devices) which can be used for storing a number of items including microcode or programming for the microprocessor 412, pay table information, information identifying or related to main game or bonusing prizes, selectable items, association between associated items and selectable items, static or moveable icons or other displays associated with selectable items and/or prizes or other associated items and the like. In the embodiment of FIG. 4, the microprocessor 412 is coupled to a prize output device 422 which can include e.g., a coin output or tray or similar coin output device 136, a card writer or encoder and/or a communication device, e.g. for crediting a remotely-located account of a player.

Figure 2:
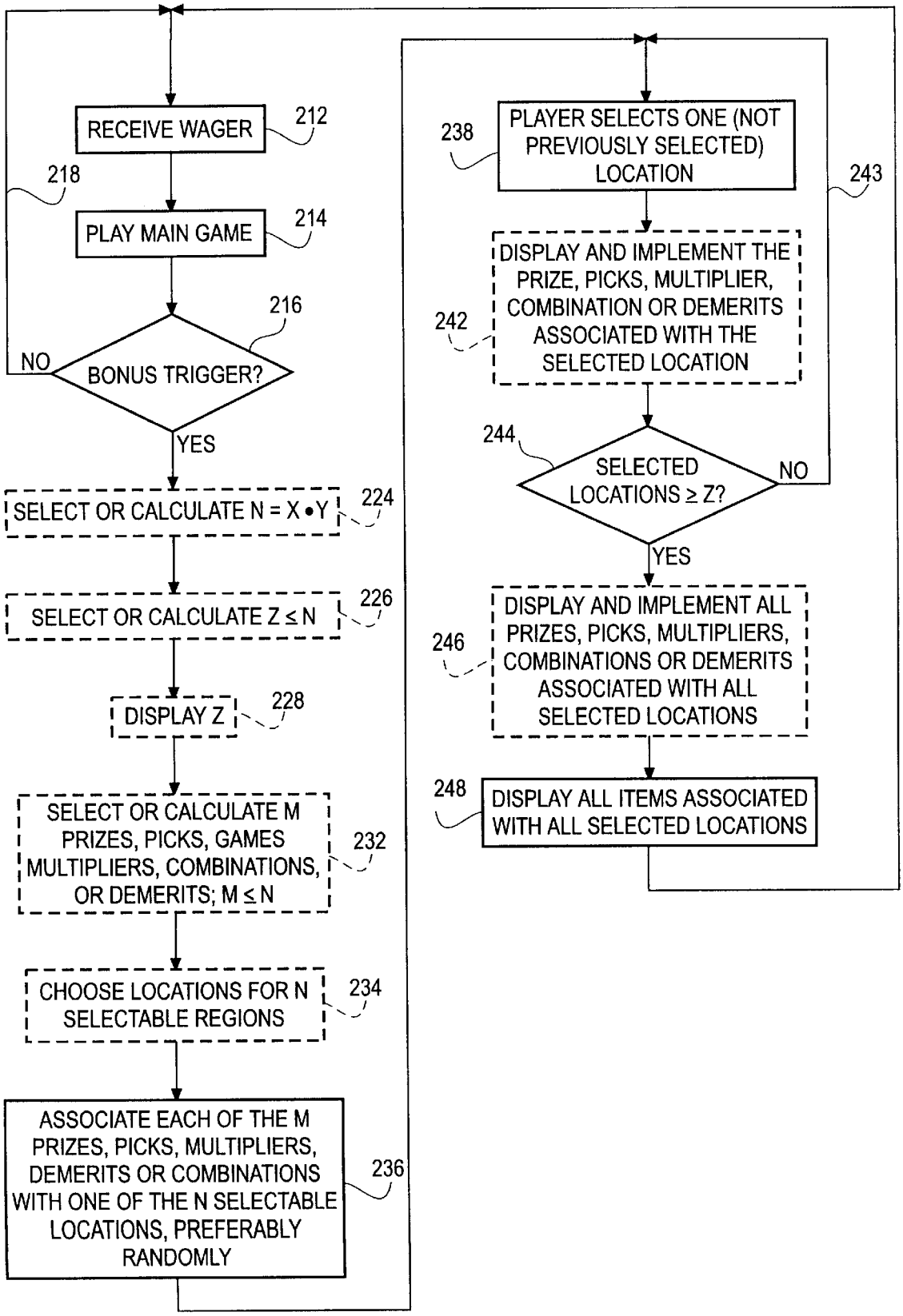
FIG. 2 is a flow chart depicting a gaming procedure according to an embodiment of the present invention.

As depicted in FIG. 2, gaming can begin with the receipt of a wager 212 which provides for play of the main game 214. In general, the main game 214 is distinguishable from a bonusing feature because there must be at least some amount of play of the main game, before initiating of the bonusing feature, and/or because the main game is the game which is most prominently featured or displayed on the gaming terminal and/or because the main game is the game on which the player wagers.

As in the embodiment of FIG. 2, the bonusing feature is initiated upon the occurrence of a bonus trigger event 216. If a bonus trigger event does not occur a procedure returns 218 to permit another wager and main game play if desired. In some embodiments, the bonus trigger 216 relates to outcomes or other aspects of the main game such as achieving certain main game results (e.g., achieving one or more bonus symbols 138 on a slot machine pay line 142, FIG. 1), play of a certain number of rounds of the main game, wagering of at least a threshold amount, accumulation of a threshold point, credit or prize amount in the main game and the like. In some embodiments, a bonus trigger 216 may occur in a fashion substantially unrelated to play of the main game such as in response to passage of a certain amount of time, or may be declared at randomly selected times.

The embodiment depicted in FIG. 2 involves a bonusing feature which permits a player to select up to a certain number (referred to herein as "Z") of items out of a plurality (referred to herein as "N") of selectable items. In some embodiments, the number of selectable items may be substantially constant or fixed for a given gaming terminal. In other embodiments, the value of N may change from time to time. For example, N may be selected based on the size of the wager for the last main game (although in some embodiments a player may be given an option to make an additional wager or side wager related to the bonusing feature, e.g., for the purpose of increasing the value of N). For example, a game could be configured such that N equals 4 if one coin was played, N equals 6 if two coins were played, and N equals 9 if 3 coins were played, and the like. In one embodiment of the invention, N may be determined at least partially in response to outcomes or other items in the main game such as in response to accumulated points or credits, the most recent main game outcome, and the like. In some embodiments, the value of N may be selected at least partially in response to past gaming conditions, so as to assist in establishing bonusing prize probabilities configured to achieve compliance with gaming regulations and/or to control or limit overall or averaged prizes, e.g. to assist in achieving a desired game operator hold or profit. In some embodiments, the value of N may be selected at least partially randomly, such as by randomly selecting a value of N from among a plurality of candidate values or among a range of values. In one embodiment, selectable items are presented as a rectangular array of X rows and Y columns and accordingly N is selected or calculated as a product of X and Y 224. In some embodiments, selection or calculation of N may involve a combination of the above-described selection or calculation modes, such as randomly selecting N from among a first range of values in response to a 2-coin wager and randomly selecting a value of N from a second range (which includes higher potential values of N) in response to a three coin wager and the like.

The number of picks which the player is permitted (i.e., the value of Z) can be a substantially constant and unchanging value for a given gaming terminal or can be a value which is selected or calculated and which may change from time to time. The value of Z can be selected or calculated 226 using any of the factors or combination factors described above in connection with selection or calculation of N, such as in response to outcome or other features of the main game, in response to amounts of wagers, to accommodate desired game operator holds or profits, to comply with gaming regulations, in a random fashion, such as randomly among a range or set of candidate Z values, or combinations thereof. Preferably, the value of Z is displayed to the user 228 such as by displaying on a display screen 143.

Some or all of the N player-selectable items are associated with "associated items". A number of items may be associated with a selectable item and accordingly, associated items can include various prizes (which can be monetary prizes, non-monetary prizes such as additional plays of the main game, or other non-monetary prizes) additional bonusing picks, increasers such as multiplication factors, as described below, demerit values, as described below, and/or combinations of two or more such items. An increaser differs from a prize in that the increaser increases or otherwise affects the value of other (typically previous) prizes. In some embodiments, increasers operate on or affect two or more prizes, such as by affecting all previous bonus prizes for the current bonus feature. A multiplier-type increaser is an increaser which multiplies the value of one or more previous prizes. For example, a ×2 multiplier will double one or more prizes, an ×3 multiplier will triple one or more prizes and the like. Multipliers or other increasers can be configured to affect all previous bonus feature prizes, all previous and subsequent bonus feature prizes, a certain number of bonus feature prizes (such as the two most recent prizes, the next two prizes and the like), all subsequent bonus feature prizes and the like. Increasers can be configured to provide an increase function other than multiplication, such as squaring or cubing, or other increasing functions as will be clear to those of skill in the art after understanding the present disclosure.

As used herein, a demerit is a function which decreases a prize value. In one embodiment, a demerit is a negative value which is thus a value subtracted from the prize total, although other decreasing functions will be understood by those of skill in the art after understanding the present disclosure. It is possible to construct operable systems in which not all of the potential associated item categories are available. For example, operable devices can be configured in which there are no demerits associated with selectable items, or in which there are no additional picks associated with selectable items. In general, it is preferred to include at least some multipliers or other increasers.

It is not necessary, in order to achieve a operable system, to provide an associated item for all the selectable items. For example, there may be some selectable items which have no associated items (or, equivalently, which are associated with blank or zero-value associated items) such that, upon selecting such a selectable item, there is no affect upon the total prize. Accordingly, the number of associated items M should be less than or equal to N. The M items are selected or calculated 232 in any of a number of fashions. In some embodiments, the M associated items may be substantially constant or unchanging in a given gaming terminal. In other embodiments, the M associated items may be selected using factors similar to those described above in connection with selection of the value N, including selecting based on results or outcomes of the main game selecting based on the amount of wagers, selecting based on desired hold or profit of a game operator, selecting based on compliance with gaming regulations, selecting based on a random selection process (e.g., randomly selecting among the plurality of candidate associated items).

The values of Z and N, and the items which are associated with some or all of the N selectable items, all affect the amount of bonusing prizes, averaged over a period of time. Accordingly, although the selection of Z, N, and the items associated with the selectable items were described above as being performed separately, it is preferred to make these selections with consideration of how the combination of these selections affects the amount of bonusing prizes averaged over a period of time. For example, if the associated items include a relatively large number of relatively high-value prizes, the effect of this on the average bonusing prizes can be at least somewhat reduced by providing a relatively low ratio of Z to N (i.e., giving the player only a relatively small number of picks among a relatively large number of selectable items). Those of skill in the art will understand how to select N, Z and the associated items in a manner to achieve various affects which as affecting the bonusing prizes averaged over a period of time.

In at least one embodiment, the selectable items are presented to the user in the form of graphics or other logos or icons on a display screen. In some embodiments, the selectable items are always located in the same location on the display screen. In other embodiments, the locations may change such as by selecting N locations for displaying the N selectable regions 234 for each bonusing round. In one embodiment, the locations are selected such as by randomly selecting them from a plurality of candidate locations. In some embodiments, the selectable regions or locations are displayed so as to provide the impression of movement, such as by providing animated graphics or icons, and/or such that the various selectable regions move across the screen.

Preferably, the M associated items are associated with selectable items in a fashion so as to avoid predictability of such associations (e.g., based on previous bonusing rounds) and is preferably performed substantially randomly. For example, if each of the M associated items is assigned an identifier number (between 1 and M), the association can be achieved by storing (e.g., in a table, stored in memory), for at least some selectable items, a randomly selected one of the integers 1 through M. Those of skill in the art will understand how to store numbers and tables in memory and will also understand how to form other manners of association.

The player selects one of the selectable locations 238 (which has not been previously selected). For example, when the selectable locations are locations displayed on a touchscreen display screen, user may select a location by touching the current location of a selectable region. In another embodiment, each selectable location may be labeled with an identifier such as a number and the player may select a region by selecting a number key 126. Preferably, as each selectable item is selected, the prize or other associated item which is associated with such selectable region is revealed or displayed 242 (although it is also possible to provide embodiments in which the associated items are displayed all at once after all Z items have been selected 246). The procedure loops 243 to allow the player to continue selecting items until all Z picks have been made 244. The items associated with the picked or selected items are implemented. For example, if an associated item includes a prize, the prize total of the bonusing is incremented by the associated prize amount. If the associated item includes one or more additional picks, the value Z is incremented the appropriate amount. If the associated item includes a multiplier, a multiplier value is applied to the appropriate previous and/or subsequent bonusing prizes. If the associated item includes a demerit, the prize amount is appropriately decreased.

Preferably, after the user has selected the Z selectable items, all items associated with all selected items are revealed or displayed 248. This will provide a player with an opportunity to see the prizes or other associated items which were not picked (if any), which is believed to add to the entertainment value of the bonusing feature and may also assist in reassuring the player as to the fairness of the game and the bonusing feature.

Figure 3A:
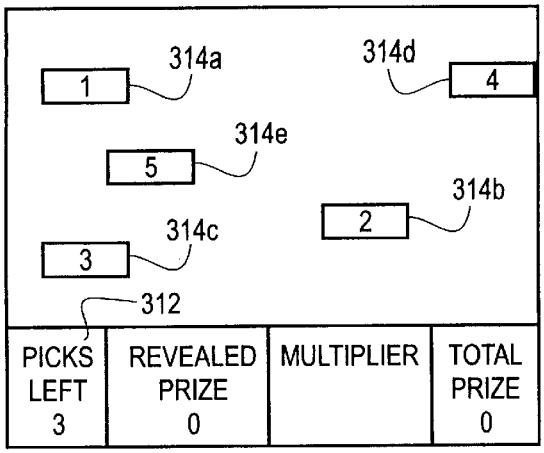
FIGS. 3A–3D are front views of display screens at successive stages of a bonusing procedure showing one example of bonusing according to an embodiment of the present invention.
Figure 3B:
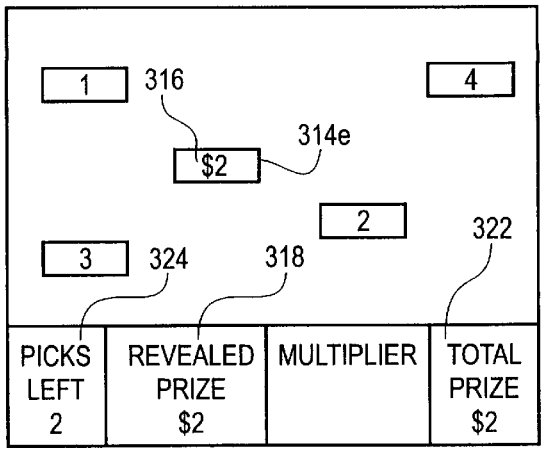
Figure 3C:
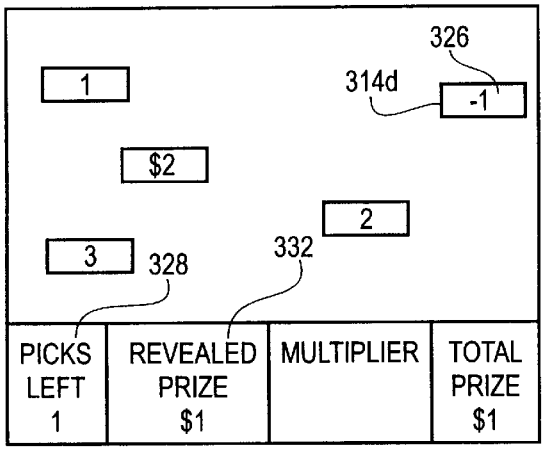

FIGS. 3A through 3D show screens as they would appear at four subsequent stages during one example of a bonusing feature according to the present invention. In the example illustrated in FIGS. 3A through 3D, the initial value of Z is 3 and the value of N is 5. Thus, as shown in FIG. 3A, the player initially is provided with 3 picks 312 and the display screen displays 5 selectable areas 314*a* through 314*e*. In the present example, it is assumed that the player initially selects the fifth area 314*e*. The apparatus responds by displaying the screen as shown in FIG. 3B in which the value associated with the fifth selectable area 314*e* is displayed or revealed and, in this case, is a prize value of $2.00 316. Accordingly, the display shows a current revealed prize of $2.00 318 and a total prize of $2.00 322. Because one of the picks has now been used, the display shows that there are now two picks left 324. In the example illustrated, it is assumed the player next selects the fourth selectable item 314*d*. In this case, the associated item is a demerit value of −1. The fourth selectable area 314*d* is displayed in a manner to reveal or display this value 326. The number of picks now left is 1 328 and the total revealed prize now totals $1.00 (332), which is equal to the $2.00 prize associated with area 314*e* minus the negative 1 demerit associated with selectable 314*d*.

Figure 3D:
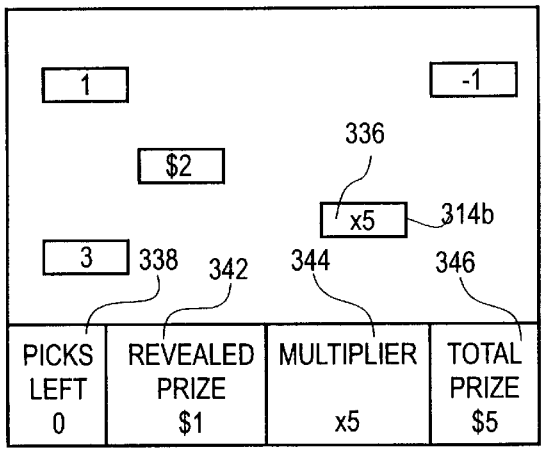

In the illustrated example, it is assumed the player next selects the second selectable area 314*b* which, in this example, has an associated item which is a multiplier with a value of ×5, which is then revealed or displayed 336. As shown in FIG. 3*d*, the player has no more picks left 338. The revealed prize is unchanged, i.e., remains at $1.00 342. However, the revealed prize is increased by the multiplier 344 so that the total prize 346 is $5.00.

In light of the above description, a number of advantages of the present invention can be seen. The present invention can assist in providing user interest and providing increased entertainment value to players by providing a fashion in which a bonus feature uses player interaction, preferably such that a bonus prize is not predetermined, at the initiation of a bonus process preferably being affected by player choices or actions such as by allowing a user to select among a plurality of selectable items. The present invention provides a fashion for a user to interact in a fashion so as to affect the amount of a bonus prize in a given round of the game, while providing for total bonus prizes, averaged over a period of time, to be controlled, limited or predictable. The present invention provides a bonusing feature which can include one or more multipliers for enhancing player interest and/or entertainment value.

A number of variations and modifications of the invention can be used. It is possible to use some features of the invention without using others. For example, it is possible to provide for a bonusing feature with user interaction as described without performing selection or calculation on the basis of guaranteeing a game operator hold or profit. Although procedures in accordance with the present invention have been described, it is possible to implement the present invention using procedures which have additional steps or fewer steps and/or in which steps are performed in an order different from that depicted. For example, the step of associating items with selectable items can be performed before the bonus trigger event occurs.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and\or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. Apparatus for providing a bonus in a gaming system played by a player, comprising:

a gaming terminal having a wager receiver and input and output devices;

electronic circuitry which associates associated items with at least some of a plurality of user-selectable items, said associated items including at least a first prize and a prize increaser;

displays at least some said selectable items, in response to a bonus trigger in a main game of said gaming system;

receives, from said player, selections of up to a predetermined number of said selectable items, said predetermined number being less than all selectable items;

credits said player with a bonus prize when an associated item associated with a selected item includes a prize; and increases all current bonus prizes when an associated item associated with a selected item includes said prize increaser.

2. Apparatus for playing a game by a player, comprising:

a gaming terminal in putting a wager acceptor, and input and output devices; and a microprocessor configured to:

control play of a main game in response to receipt of a wager;

initiate a bonus procedure in response to occurrence, in said main game, of a bonus trigger event, wherein, during said bonus procedure, said microprocessor is configured to display a plurality of player-selectable items, each associated with a prize or a multiplier;

display a number indicating the number of picks which the player can exercise, said number of picks being less than the total plurality of player selectable items;

display, in response to each picked player-selectable item, said prize or multiplier associated with said picked item; adding a prize amount to a prize total when a prize is associated with said picked item;

and multiplying said prize total by a multiplier value when a multiplier is associated with said picked item;

display items associated with all said player-selectable items after said number of picks has been exercised by said player.

3. A game-playing method comprising:

receiving a wager in a gaming terminal;

playing a main game portion at said gaming terminal;

initiating a bonus portion in response to a main game portion;

associating each of a plurality of player-selectable items with an associated item, said associated item being at least one of a prize, a multiplier, a demerit or a combination thereof;

displaying said plurality of player-selectable items;

receiving, from said player, input indicating up to a predetermined number of picks of said player-selectable items; said number of picks being less than the total plurality of player selectable items;

increasing a prize total by a prize value for each picked player-selectable item associated with an associated item which includes a prize; and multiplying a prize total by a prize value for each picked player-selectable item associated with an associated item which includes a multiplier.

4. A method, as claimed in claim 3, wherein said step of associating comprises randomly associating.

5. A method, as claimed in claim 3 further comprising selecting one number of a number of a variable number of player-selectable items.

6. A method, as claimed in claim 5 wherein said step of selecting the number of player-selectable items is performed according to at least one of:

a random selection process within a range;

a wager-based selection process;

an average-hold selection process.

7. A method, as claimed in claim 3 wherein said step of associating includes selecting said associated items according to at least one of:

a random selection process within a range;

a wager-based selection process;

an average-hold selection process.

8. A method, as claimed in claim 3 further comprising selecting said predetermined number of picks.

9. A method, as claimed in claim 8 wherein said step of selecting said predetermined number of picks is performed according to at least one of:

a random selection process within a range;

a wager-based selection process;

an average-hold selection process.

10. A method, as claimed in claim 3, further comprising displaying said predetermined number of picks.

11. A method, as claimed in claim 3, further comprising randomly selecting locations for display of said player-selectable items.

12. A method, as claimed in claim 3, wherein said step of displaying said plurality of player-selectable items includes displaying at least one of said plurality of player-selectable items to provide the appearance of motion.

13. A device for game-playing comprising:

a gaming terminal having apparatus for receiving a wager and having input and output apparatus for playing a main game portion;

apparatus for initiating a bonus procedure;

apparatus for associating each of a plurality of displayable player-selectable items with an associated item, said associated item including at least of a prize, a multiplier, a demerit, or a combination thereof;

apparatus for displaying said plurality of player-selectable items;

apparatus for receiving, from said player, input indicating up to a predetermined number of picks of said player-selectable items, said number of picks being less than the total plurality of player selectable items;

apparatus for increasing a prize total by a prize value for each picked player-selectable item associated with an associated item which includes a prize; and apparatus for multiplying a prize total by a prize value for each picked player-selectable item associated with an associated item which includes a multiplier.

14. The device of claim 13, wherein said apparatus for associating comprises apparatus for randomly associating.

15. The device of in claim 13 further comprising apparatus for selecting the number of player-selectable items.

16. The device of claim 15 wherein said apparatus for selecting the number of player-selectable items comprises apparatus for selecting according to at least one of:

a random selection process within a range;

a wager-base selection process;

an average-hold selection process.

17. The device of claim 13 wherein said apparatus for associating includes apparatus for selecting said associated items according to at least one of:

a random selection process within a range;

a wager-base selection process;

an average-hold selection process.

18. The device of claim 13 further comprising apparatus for selecting said predetermined number of picks.

19. The device of claim 18 wherein said apparatus for selecting said predetermined number of picks includes apparatus for selecting according to at least one of:

a random selection process within a range;

a wager-base selection process;

an average-hold selection process.

20. The device of claim 13, further comprising apparatus for displaying said predetermined number of picks.

21. The device of claim 13, further comprising apparatus for randomly selecting locations for a display of said player-selectable items.

22. The device of claim 13, wherein said apparatus for displaying said plurality of player-selectable items includes apparatus for displaying at least one of said plurality of player-selectable items to provide the appearance of motion.

23. A game-playing method comprising:

receiving a wager in a gaming terminal;

playing a main game portion at said gaming terminal;

initiating a bonus portion in response to a main game portion;

associating each of a plurality of player-selectable items with an associated item, said associated item being at least one of a prize, a multiplier, a demerit, or combination thereof;

displaying said plurality of player-selectable items;

receiving, from said player, input indicating up to a predetermined number of picks of said player-selectable items;

increasing a prize total by a prize value for each picked player-selectable item associated with an associated item which includes a prize;

multiplying a prize total by a prize value for each picked player-selectable item associated with an associated item which includes a multiplier; and decreasing said prize total for each picked player-selectable item associated with an associated item which includes a demerit.

24. A device for game playing comprising:

a gaming terminal having apparatus for receiving a wager and having input and output apparatus for playing a main game portion;

apparatus for initiating a bonus procedure;

apparatus for associating each of a plurality of displayable player-selectable items with an associated item, said associated item including at least one of a prize, a multiplier, a demerit, or a combination thereof;

apparatus for displaying said plurality of player-selectable items;

apparatus for receiving, from said player, input indicating up to a predetermined number of picks of said player-selectable items;

apparatus for increasing a prize by a prize value for each picked player selectable item associated with an associated item which includes a prize;

apparatus for multiplying a prize total by a prize value for each picked player-selectable item associated with an associated item which includes a multiplier; and apparatus for decreasing said prize total for each picked player-selectable item associated with an associated item which includes a demerit.

25. The apparatus of claim 1 which further:

shows the player at the end of the game the prizes associated with the player-selectable items not selected by the player.

26. The method of claim 3 including the further step of:

at the end of the game showing the player the prizes associated with player-selectable items not selected by the player.

27. The method of claim 23 in which:

at the end of the game showing the player the prizes associated with player-selectable items not selected by the player.

28. The method of claim 23 in which said predetermined number of picks is less than the total plurality of player-selectable items.

29. The device of claim 24 in which the predetermined number of picks is less than the total plurality of player selectable items.

* * * * *